United States Patent [19]

Moore

[11] Patent Number: 4,641,786

[45] Date of Patent: Feb. 10, 1987

[54] NOZZLE FOR CRYOGENIC CLEANING APPARATUS

[75] Inventor: David E. Moore, Cincinnati, Ohio

[73] Assignee: Cryoblast, Inc., West Haven, Conn.

[21] Appl. No.: 682,262

[22] Filed: Dec. 14, 1984

[51] Int. Cl.[4] ..... B05B 7/14; B24C 5/04

[52] U.S. Cl. ..... 239/590; 51/439; 239/600

[58] Field of Search ..... 239/590, 594, 600, DIG. 21; 51/427, 439

[56] References Cited

U.S. PATENT DOCUMENTS 2,836,013 5/1958 Koenig ..... 51/427
3,705,693 12/1972 Franz ..... 239/600
4,478,368 10/1984 Yie ..... 239/600

FOREIGN PATENT DOCUMENTS 899151 1/1982 U.S.S.R. .

*Primary Examiner*—Andres Kashnikow
*Attorney, Agent, or Firm*—Frank J. Thompson

[57] ABSTRACT

An improved nozzle for a cryogenic cleaning device is provided which includes a demountable member having a constriction which causes shattering of sublimable, cryogenic particles to enhance their abrasiveness.

3 Claims, 7 Drawing Figures

NOZZLE FOR CRYOGENIC CLEANING APPARATUS

BACKGROUND

1. Field of the Invention

This invention relates to blast cleaning devices which use solid cryogenic particles as the cleaning medium. The invention relates more particularly to an improved nozzle which accelerates such solid particles to a high velocity by means of air pressure for purposes of impacting a surface to be cleaned.

2. Description of the Prior Art

Nozzles are known in which the air pressure and pellets entering the nozzle are accelerated to a sonic velocity which is then suitable for cleaning a contaminated surface. However, known devices of this type do not provide an adequate sealing means for the cryogenic temperatures involved. They also do not provide the proper nozzle size or nozzle length so as to be compatible with the type of pellets and amount of air being discharged.

SUMMARY OF THE INVENTION

Accordingly, it is an object of this invention to provide an improved means for accelerating transport air and pellets to a sonic velocity.

It is another object of the invention to provide an improved means for readily directing the pellets at a body to be treated.

It is a further object of the invention to provide an improved nozzle having means to fracture the pellets on entry to the nozzle to produce irregular and ragged edges for more effective cleaning.

BRIEF DESCRIPTION OF THE DRAWINGS

These and other objects and features of the invention will become apparent with reference to the following specification and to the drawings wherein.

DETAILED DESCRIPTION

The blast nozzle accelerates pellets entering the nozzle to a sonic velocity which is then suitable for cleaning a contaminated surface. The device has a quick change nozzle arrangement to accommodate different nozzle sizes for accomplishing specific cleaning purposes. The nozzle also fractures the pellets on entry to the nozzle section and produces irregular and ragged edges on the particles for more effective cleaning.

Figure 1A:
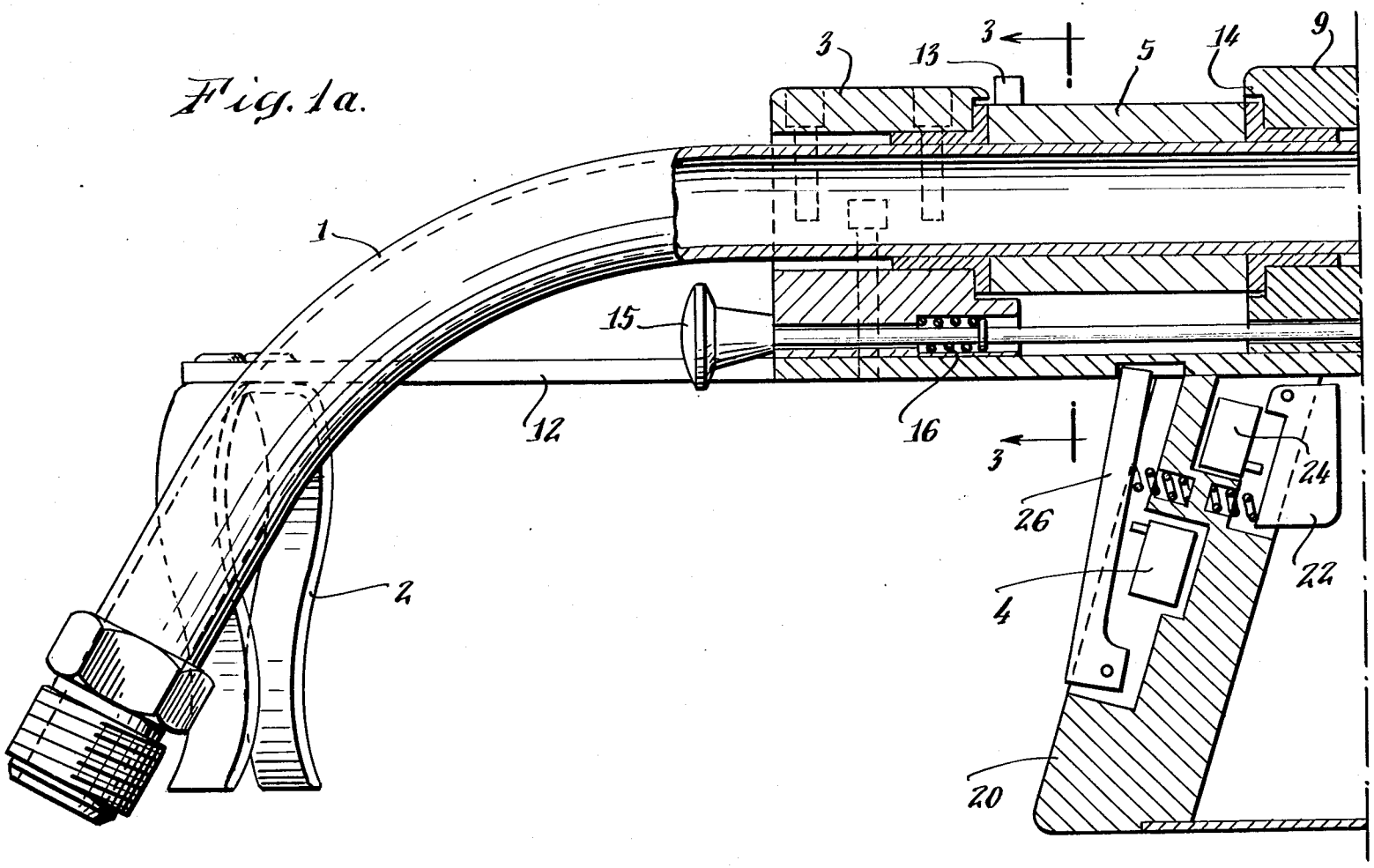
FIG. 1*a* and *b* is a top view of a nozzle of this invention.
Figures 1B, 3:
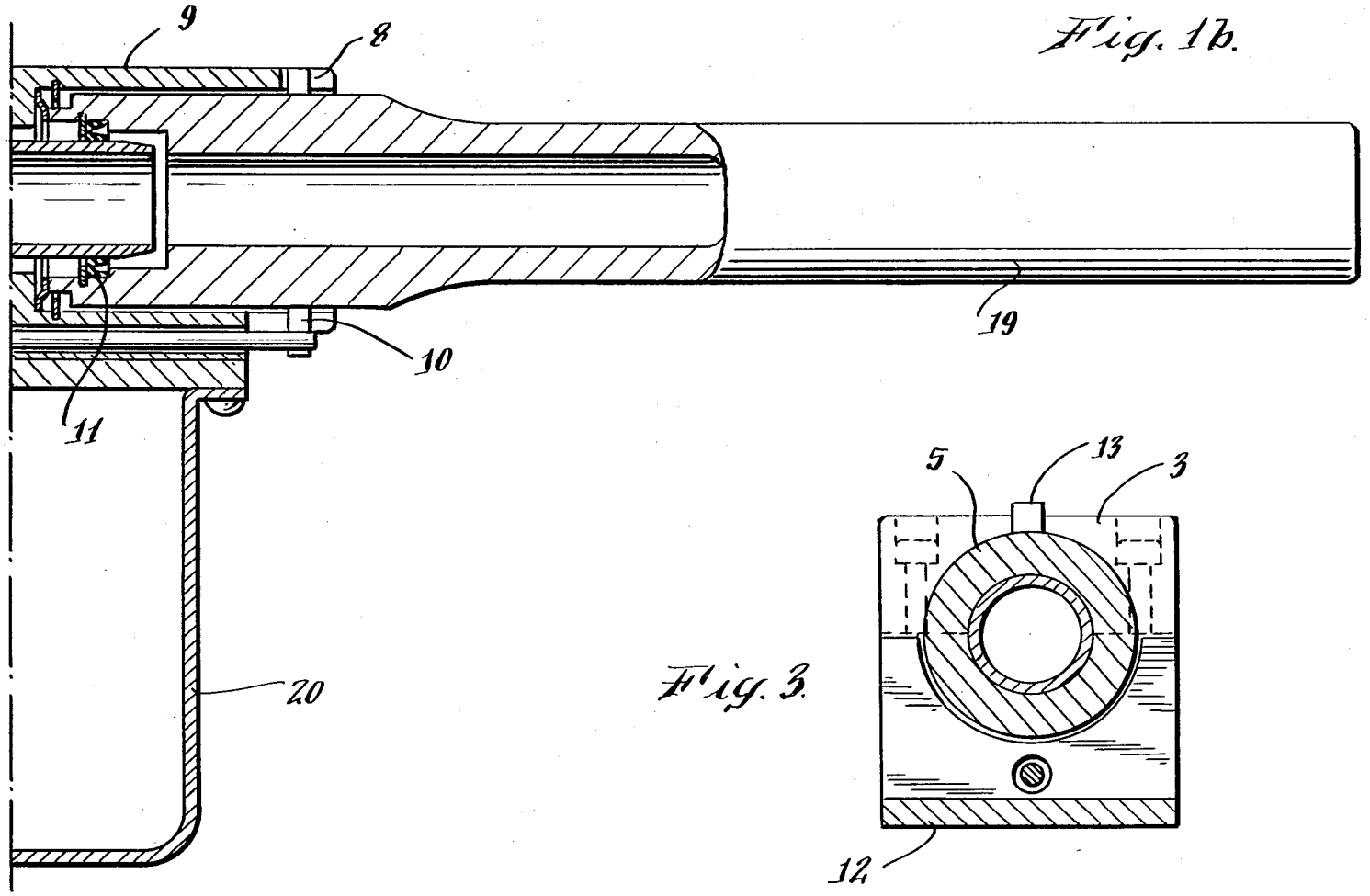
FIG. 3 is a section taken along line 3—3 of FIG. 1.
Figure 2:
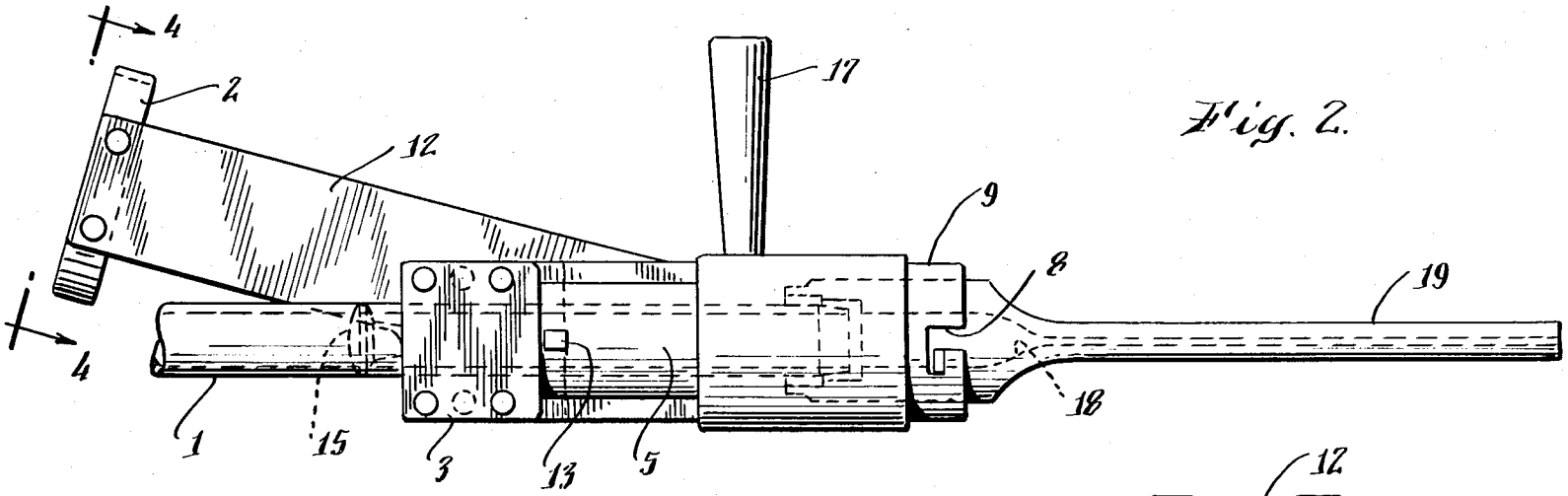
FIG. 2*a* and *b* is a side view of the nozzle of FIG. 1 which illustrates the pellet passage sealing means, nozzle interchange and safety devices.
Figure 4:
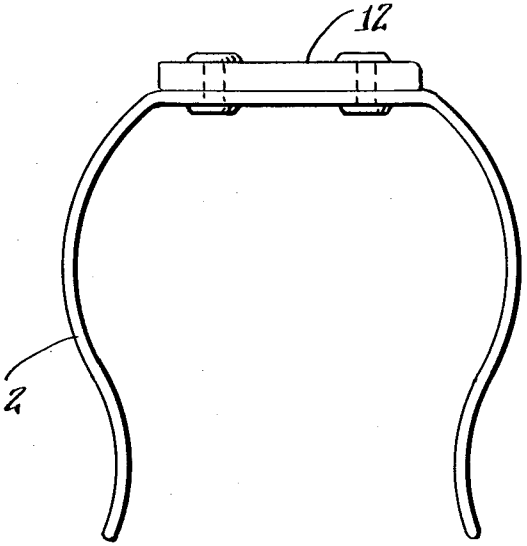
FIG. 4 is a view taken along line 4—4 of FIG. 2.
Figure 5:
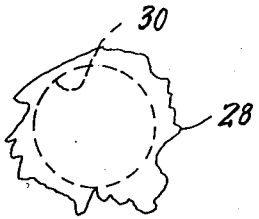
FIG. 5 is an enlarged view illustrating the relative size of pellets and nozzle constriction.

An entry tube 1 is positioned adjacent to a base plate 12 to which is mounted a forearm stabilizer 2 which allows clearance between an operator's arm and a transport hose. An optional handle 17 is provided. A system for producing pellets is disclosed and claimed in copending application Ser. No. 636,372 which is assigned to the Assignee of the invention. Pellets 28 (FIG. 5) from the pellet source, not shown, flow through a flexible transport hose, not shown, to tube 1 and thence into the nozzle area where they are accelerated to sonic velocity and fractured to produce ragged edges for greater abrasive ability. A support means comprising generally an entry tube 1, the entry guide 3, a spacer 5, a locating boss 15 and handles 17 and 20 support a nozzle 19. The entry tube is held in place by a spacer 5 which is located between an entry guide 3 and a locating boss 14. This assembly allows an operator to rotate the nozzle assembly about its longitudal axis within the limits of rotation of the stop 13 which comprises about 90° either side of the vertical handle position. The nozzle 19 slides into the guidesleeve 9 and is rotated to a locked position in a bayonette block 8. The antirotation latch 10 which is spring loaded by spring 16 locks the nozzle to prevent rotating and unlocking. The latch release handle 15 unlocks the nozzle for removal. The nozzle seal 11 is retained in the nozzle and provides sealing between the entry tube and the nozzle entrance against air leakage. A pistol grip handle 20 supports a trigger 22. The trigger actuates a switch 24 which controls an electrically energized valve, not shown, for enabling flow of the pellets from the source. An interrupt switch 4 is also provided for disabling the flow when a palm lever 26 is released. FIG. 5 illustrates the cross sectional sizes of a cryogenic pellet 28 and the nozzle constriction 30. In view of their relative sizes, fracturing of the pellets occurs and results in a more abrasive pellet surface which enchances cleaning characteristics.

An improved blast nozzle has thus been described for use with a cryogenic blast clearing apparatus. The nozzle advantageously facilitates substitution of members to meet specific applications, provides for fracturing incoming pellets and provides an enhanced seal.

What is claimed is:

1. A nozzle for directing pellets at a body to be cleaned, said pellets formed of a solid state material which sublimes to a vapor state after impact with the body, comprising:

(a) an elongated, demountable, nozzle body having a pellet entrance constriction thereof;

(b) a support means for demountably receiving and supporting said nozzle body;

(c) means for conveying pellets to said support means for acceleration toward said constriction;

(d) said constriction having a limiting passage which is smaller in cross-sectional area than pellets conveyed to said nozzle body whereby said pellets are fractured upon impact with said constriction and are accelerated to a sonic velocity.

2. The apparatus of claim 1 including means for demountably positioning said nozzle body on said support means.

3. The apparatus of claim 2 including means for providing an airtight seal between said demountable nozzle body and said support means.

* * * * *